United States Patent [19]

Sakamaki et al.

[11] Patent Number: 4,657,493

[45] Date of Patent: Apr. 14, 1987

[54] ROTARY-SLEEVE SUPPORTING APPARATUS IN ROTARY COMPRESSOR

[75] Inventors: Hiroshi Sakamaki, Utsunomiya; Yukio Horikoshi, Kazo; Kikuji Yanagihashi, Yono, all of Japan

[73] Assignee: Nippon Piston Ring Co., Ltd., Tokyo, Japan

[21] Appl. No.: 697,591

[22] PCT Filed: May 19, 1984

[86] PCT No.: PCT/JP84/00253

§ 371 Date: Jan. 11, 1985

§ 102(e) Date: Jan. 11, 1985

[30] Foreign Application Priority Data

May 20, 1983 [JP] Japan ..... 58-087731

[51] Int. Cl.[4] ..... F04C 18/348

[52] U.S. Cl. ..... 418/173

[58] Field of Search ..... 418/173

[56] References Cited

U.S. PATENT DOCUMENTS 4,479,763 10/1984 Sakamaki et al. ..... 418/173

*Primary Examiner*—Leonard E. Smith

*Attorney, Agent, or Firm*—Birch, Stewart, Kolasch and Birch

[57] ABSTRACT

An apparatus provided in a rotary compressor comprising an air-bearing room (40) defined between the inner periphery of the center housing (22) and the outer periphery of the rotary sleeve (30) to have an air-bearing effect for floatingly supporting the rotary sleeve rotating with a plurality of vanes. The air-bearing room (40) is supplied with air through an inlet passage (45) and/or a connecting passage (49), if necessary. A buffer chamber (47, 57) is formed in the wall of the center housing (22) and opened to the inner periphery of the center housing (22) through tiny bores (48, 58). The rotary sleeve (30) is pushed back to the center by a buffering action of air in the buffer chamber whenever it is put aside toward the center housing (22), thereby being prevented against a direct contact with the inner periphery of the center housing (22).

11 Claims, 15 Drawing Figures

ROTARY-SLEEVE SUPPORTING APPARATUS IN ROTARY COMPRESSOR

TECHNICAL FIELDS

The present invention relates to an apparatus for supporting a rotary sleeve rotatable with vanes in a rotary compressor, and more particularly to an improved apparatus for supporting the rotary sleeve by an air-bearing effect produced in a filmy air-bearing room defined between the inner periphery of the center housing of the rotary compressor and the outer periphery of the rotary sleeve.

BACKGROUND ART

The inventors of this application have previously proposed a vane-type rotary compressor provided with a rotary sleeve interposed between a center housing and a rotor, under Japanese Patent Application No. 56-162025 (JP, A, 58-65988). The compressor is particularly suitable for use with an automobile engine required to operate over a wide speed range because of being substantially free from frictional heat as well as wear at the apex of each vane. However, there is the possibility of scuffing and seizure troubles if air is highly compressed in the compression working space within the compressor to push the rotary sleeve from within to the inner periphery of the center housing.

From a study on the movement of the rotary sleeve, it has been clarified that a contact between the rotary sleeve and the center housing takes place not at a specific line but in a relatively wide zone. The inventors have proposed under patent application No. 58-28608 (JP, A, 59-155589) that the air inlet is provided at the starting line of the zone in which the rotary sleeve is likely to contact and is internally connected to the open air, the discharge chamber, and the compression working space under the maximum pressure to increase an amount of air flowing over the zone. However, when a sudden change occurs in the rotational speed of the internal combustion engine, the rotor is driven to rotate. The rotary sleeve abnormally moves to contact the suction side inner periphery of the center housing, thereby rotating in a disorderly manner.

It is the primary object of the invention to provide an apparatus by which the rotary sleeve is floatingly supported without contacting the compression side inner periphery of the center housing when compressed air pushes the rotary sleeve from within to the compression side inner periphery and the suction side inner periphery when a sudden change occurs in the rotational speed of the rotor to move the rotary sleeve toward the suction side inner periphery.

DISCLOSURE OF INVENTION

The apparatus of the invention comprises a buffer chamber formed in either or both of the compression and suction sides of the center housing. The buffer chamber is located in the thickened portion of the center housing surrounding the rotary sleeve and is opened to an air-bearing room defined between the inner periphery of the center housing and the outer periphery of the rotary sleeve through a plurality of tiny bores.

In addition to the buffer chamber, the apparatus is preferably provided with an air passage, as an aerodynamic means, to increase an amount of air flowing over the zone which the rotary sleeve is likely to contact. The air passage extends to the starting line of the zone from the atmosphere, the discharge chamber, or the compression working space which is defined by two adjacent vanes and situated just before a position in which the space is connected to the discharge chamber.

BEST MODE FOR CARRYING OUT THE INVENTION

Figure 1:
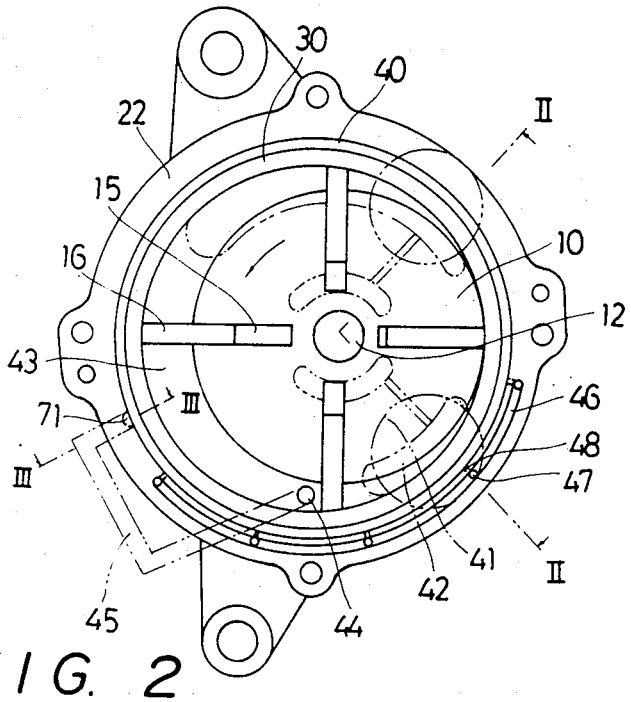
FIG. 1 is a side elevation of the rotary compressor according to the invention, the rear side housing being eliminated for illustration of the side surface of the rotor.

The invention will be explained with reference to drawings which illustrate specific embodiments. Referring initially to FIG. 1, the compressor has a rotor 10 eccentrically disposed in the rotary sleeve 30. The rotor 10 rotates in the direction as indicated by an arrow and has a plurality of vanes 16 movably fitted in the respective vane grooves 15. The vane 16 has its apex in contact with the inner periphery of the rotary sleeve 30. The rotary sleeve 30 is floatingly supported in the air-bearing room 40 confined between the inner periphery of the center housing 22 and the outer periphery of the rotary sleeve 30. The radial width of the air-bearing room 40 is exaggeratedly shown but really very thin, being less than 0.1 mm.

The working space 43 is defined by the two adjacent vanes 16 to turn round within the rotary sleeve. The pressure in the working space 43 is low in the suction side and high in the compression side, being maximum when the space is just before a position in which it is connected to the discharge chamber 41 through the discharge port 42. An extract port 44 is given to the working space 43 under the maximum pressure and internally connected to the inlet port 71 in the compression side inner periphery of the center housing 22 through an inlet passage 45. Although the passage 45 is shown as it were outside the center housing 22, it really passes within the center housing.

A buffer chamber is composed of an arcuate groove 46 formed in the compression side end surface of the center housing 22, a plurality of blind holes 47 extending axially from the arcuate groove 46 into the wall of the center housing 22, and tiny bores 48 extending radially from each blind hole 47 to the inner periphery of the center housing 22.

Figure 2:
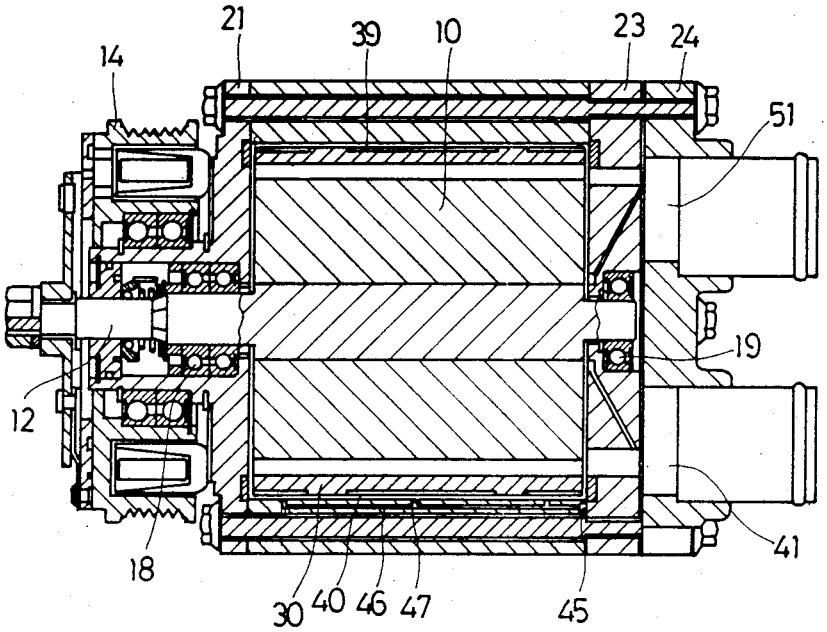
FIG. 2 is a section taken along the line II—II of FIG. 1.

As seen in FIG. 2, the rotor 10 is integrally shaped with a shaft 12 rotatably supported by bearings 18, 19 in the respective front and rear housings 21, 23 and fixed at the front end thereof to a pulley 14 which is rotated by a non-illustrated engine. A gasket is interposed between the rear housing 23 and the rear cover 24 in which the discharge chamber 41 and the suction chamber 51 are provided. The embodiment has an arcuate groove 46 formed in the rear side end surface of the center housing 22. The arcuate groove can be formed in either or both of the paired end surfaces of the center housing and the front and rear side housings. The blind holes 47 extend axially into the wall of the center housing 22 from the arcuate groove 46. The tiny bores 48 are symmetrically disposed with respect the central cross-section of the air-bearing room 40 to extend radially from the blind holes 47 to the inner periphery of the center housing 22. Thus, a connecting passage (49) connects a discharge chamber (41) to the air-bearing room (40) through the blind holes (47) and the arcuate groove (46).

Figure 3:
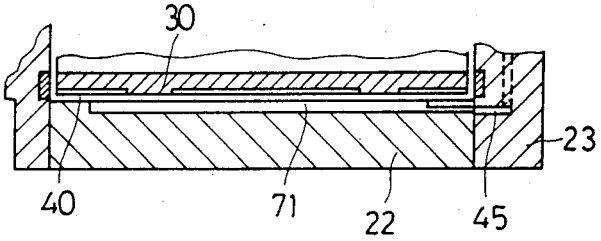
FIG. 3 is a section taken along line III—III of FIG. 1.
Figure 4:
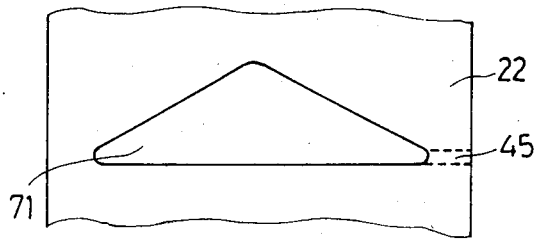
FIG. 4 is a development of the inlet port.
Figure 5:
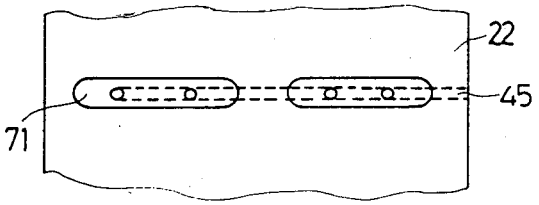
FIGS. 5 and 6 are views, similar to FIG. 4, of different embodiments.
Figure 6:
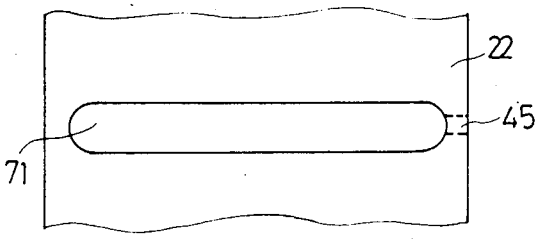

As seen in FIG. 3, the inlet passage 45 passes through the rear side housing 23 to terminate at the inlet port 71 in the inner periphery of the center housing 22. The inlet port 71 axially elongates and opens to the radially thin air-bearing room 40. The inlet port 71 is shaped in the form of a groove, as the exit of the inlet passage 45. The inlet port is not limited to a linear one. For example, it can be shaped in any form of an equilateral triangle as seen in FIG. 4, double split linear grooves as seen in FIG. 5, and a single groove extending to the vicinity of the opposite ends as seen in FIG. 6.

As the compressor rotates, air in the working space 43 of FIG. 1 is pressured to push the rotary sleeve 30 toward the compression side. Whenever the rotary sleeve 30 is pushed toward the compression side inner periphery in which a buffer chamber is defined by the arcuate groove 46, the blind holes 47 and the tiny bores 48, it is pushed back by the buffering action of the buffer chamber and prevented from direct contact with the inner periphery of the center housing 22.

High-pressure air is introduced through the inlet port 71 at the starting line of the contact zone to increase an amount of air flowing along the contact zone which the rotary sleeve 30 is likely to contact. Whenever the rotary sleeve is put aside toward the contact zone, the air over the zone is pressured to increase the bearing effect and prevent the rotary sleeve from contacting the inner periphery of the center housing 22. The pressured air enters the blind holes 47 through the tiny bores 48 and then spreads over all the blind holes through the arcuate groove 46 to balance the bearing effect over all the contact zone, thereby no part of the contact zone being in contact with the rotary sleeve 30.

Figure 7:
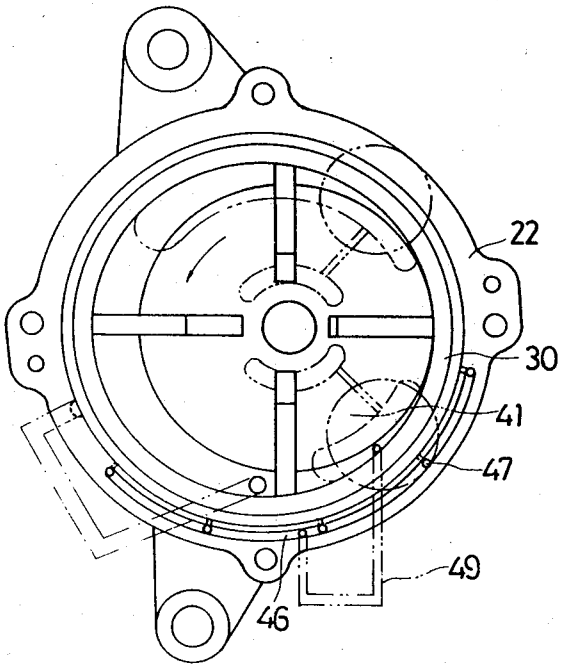

As seen in FIG. 7, the blind holes 47 are internally connected to the discharge chamber 41 through a high-pressure passage 49 extending from the discharge chamber 41 to the arcuate groove 46 to increase a buffering action of the buffer chamber, thereby the rotary sleeve 30 being more effectively prevented from contacting the inner periphery of the center housing 22.

It is preferable for the rotary sleeve 30 to have the outer periphery thereof formed with herringbone air-accumulating grooves 39 the section of which is shown in FIG. 2 for the purpose of increasing the bearing effect of air flowing along the inner periphery of the center housing 22.

Figure 8:
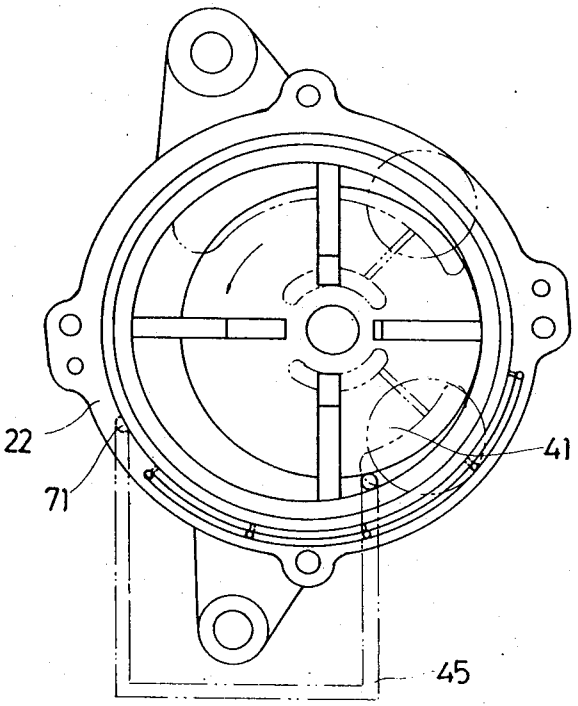
FIGS. 7 and 8 are views, similar to FIG. 1, of different embodiments.

The inlet passage is not always required to be connected to the working space under the maximum pressure. As seen in FIG. 8, the inlet passage 45 can extends from the discharge chamber 41 to the compression side inner periphery of the center housing 22. The inlet passage 45 may have as an exit an inlet port 71 at the starting line of the zone which the rotary sleeve is likely to contact. The rotary sleeve acts as a pump whenever it rotates at high speeds, so that an inlet port vent to the atmosphere may be useful to increase an amount of air flowing over the contact zone.

Figure 12:
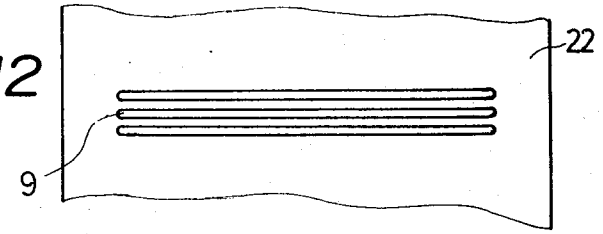
FIGS. 10 and 12 are views, similar to FIG. 9, of other embodiments.
Figure 13:
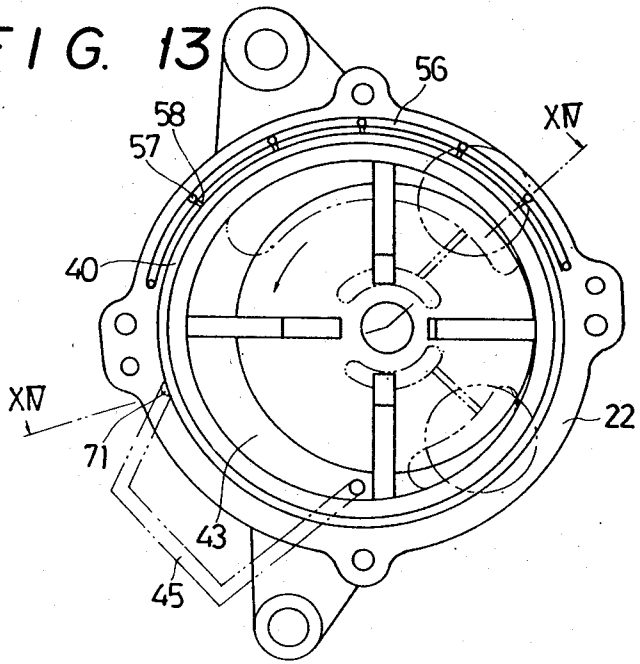
FIG. 13 is a view, similar to FIG. 1, of another embodiment
Figure 9:
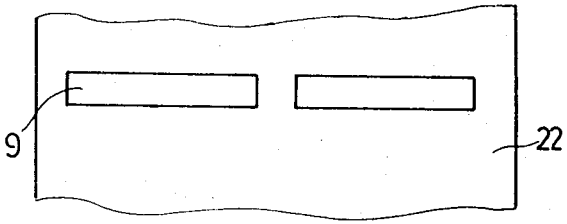
FIG. 9 is a development of an air-accumulating groove.
Figure 10:
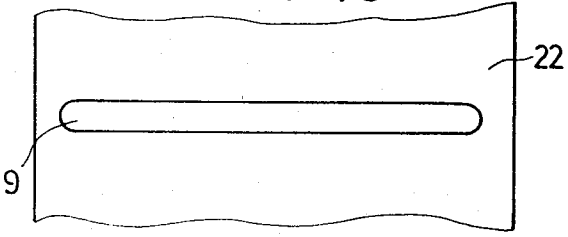
Figure 11:
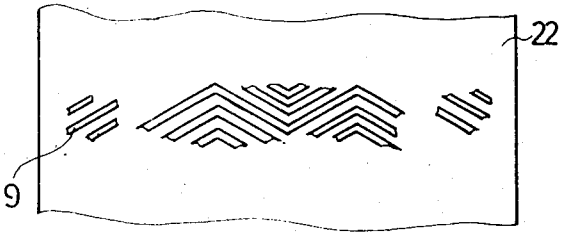
Figure 14:
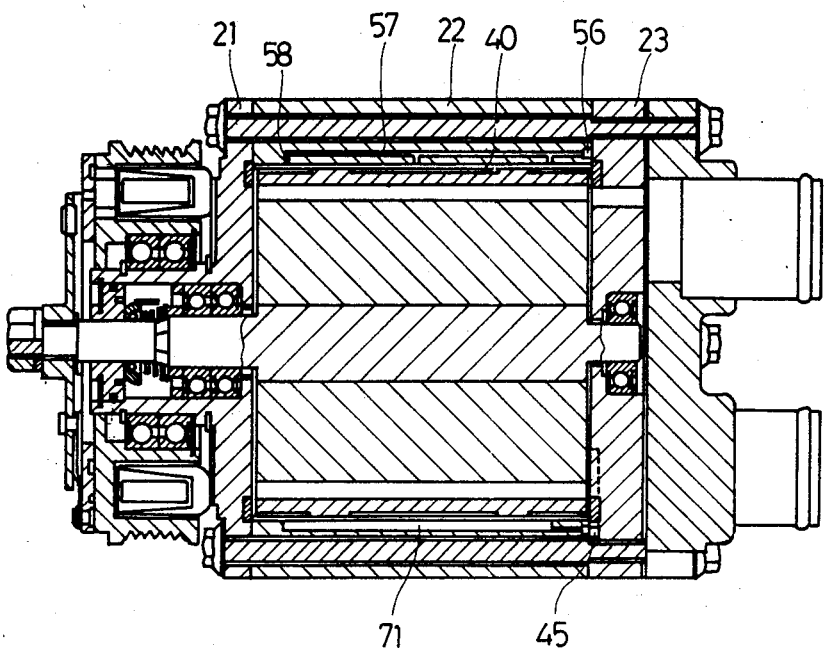
FIG. 14 is a section taken along the line XIV—XIV.

A sudden change in the rotational speed of engine causes an abnormal movement of the rotary sleeve with the result that the rotary sleeve sometimes occurs to contact the suction side inner periphery of the center housing. By way of precaution against a direct contact between the rotary sleeve and the suction side inner periphery of the center housing, the air-accumulating grooves 9 are preferably provided in the suction side inner periphery, opposite to the contact zone, of the center housing 22 as seen in FIG. 9. The air-accumulating groove 9 can be shaped in any form of a pair of rectilinear grooves as shown in FIG. 9, a single rectilinear groove as shown in FIG. 10, a group of herringbone grooves as shown in FIG. 11 and a group of narrow linear grooves as shown in FIG. 12. As seen in FIGS. 13 and 14, an arcuate groove 56 formed in the suction side end surface of the center housing 22, a plurality of blind holes 57 extending axially in the wall of the center housing 22, and tiny bores 58 opened to the inner periphery of the center housing 22 from the blind holes 57 form another buffer chamber to increase the bearing effect in the suction side of the air-bearing room 40 and prevent the rotary sleeve more effectively from contacting the suction side inner periphery of the center housing 22 when the rotary sleeve makes an abnormal movement. The arcuate groove 56 can be formed in either or both of paired surfaces of the center housing 22 and the front and rear side housings 21, 23. The tiny bores 58 are symmetrically disposed with respect to the central cross-section of inner periphery of the center housing.

Whenever the rotary sleeve 30 lies toward the suction side inner periphery of the center housing 22, the buffer chamber composed of tiny bores 58 and blind holes 57 produce a buffering action to push back the rotary sleeve 30 toward the center. Air enters the contact zone through the inlet port 71 of the inlet passage 45 from the discharge chamber 41 or working space 43 under the maximum pressure to increase the bearing effect of the air-bearing room 40 and prevent the rotary sleeve 30 from contacting the contact zone of the center housing 22, thereafter going round to the suction side opposite to the contact zone. The air enters the blind holes 57 through the tiny bores 58 to spread in the the buffer chamber through the arcuate groove 56, thereby also preventing the rotary sleeve 30 from contacting the suction side inner periphery of the center housing 22 when an abnormal movement of the rotary sleeve 30 occurs.

Figure 15:
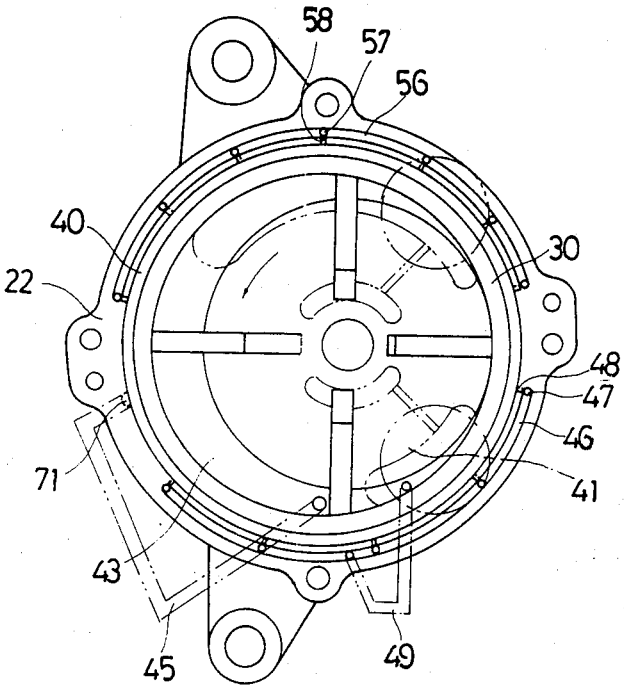
FIG. 15 is a view, similar to FIG. 1, of still another embodiment.

As seen in FIG. 15, the air-bearing room 40 can be provided with a buffer chamber composed of two separate portions, one in the compression side of the center housing 22 and the other in the suction side. The buffer chamber has its compression side portion consisting of an arcuate groove 46 in the compression side end of the center housing 22, a plurality of blind holes 47 extending axially from the arcuate groove into the wall of the center housing 22, and tiny bores 48 extending radially from each blind hole to the inner periphery of the center housing 22. The arcuate groove 46 can be connected to the discharge chamber 41, if a strong buffering action is required to push back the rotary sleeve which lies toward the compression side inner periphery of the center housing 22.

The suction side portion consists of an arcuate groove 56 in the suction side end of the center housing 22, a plurality of blind holes 57, and tiny bores 58 radially branched from each blind hole and opened to the inner periphery of the center housing 22 to push back the rotary sleeve 30 to the center when the rotary sleeve lies toward the suction side inner periphery of the center housing 22. In the embodiment of FIG. 15, the maximum-pressure air in the working space 43 enters the air-bearing room 40 from the inlet port 71 at the starting line of the contact zone through the inlet passage 45 to increase the bearing effect. The air also enters the compression side of the buffer chamber through the tiny bores 48 to produce a more effective buffering action for preventing the rotary sleeve from contacting the compression side inner periphery of the center housing. Thereafter, the air goes round to enter the suction side of the buffer chamber through the tiny bores 58 in the suction side to increase the buffering action for preventing the rotary sleeve from contacting the suction side inner periphery of the center housing 22.

The apparatus of the invention has a filmy air-bearing room defined between the outer periphery of the rotary sleeve and the inner periphery of the center housing and a buffer chamber formed in either or both of the compression and suction sides of the center housing to fluidly support the rotary sleeve. Therefore, it has an advantage that the buffer chamber produces a buffering action to prevent direct contact between the rotary sleeve and the center housing both when compressed air pushes the rotary sleeve from within to the compression side inner periphery of the center housing and when a sudden change in the rotational speed of engine causes an irregular motion of the rotary sleeve. This advantage is not obtained from the conventional apparatus without a buffer chamber. The apparatus can have the inlet port to supply air to the air-bearing room. The supplied air increases the bearing effect on the contact zone and then enters the buffer chamber to produce a more effective buffering action for protection against direct contact between the rotary sleeve and the center housing, resulting in another advantage that scuffing troubles between the rotary sleeve and the center housing and problems due to an irregular rotation of the rotary sleeve are expected to be remarkably reduced as compared with the conventional apparatus.

INDUSTRIAL APPLICABILITY

The rotary compressor provided with the inventive apparatus for fluidly supporting a rotary sleeve which is rotatable with vanes is suitably used as a supercharger for an internal combustion engine, especially for an automobile engine. The reason for this is that frictional heat as well as wear is relatively small during rotation and that it has less scuffing troubles under high speed running or sudden speed change operations.

What is claimed is:

1. An apparatus for supporting the rotary sleeve in a rotary compressor, comprising:

a center housing;

a rotary sleeve rotatably mounted in said center housing;

a plurality of vanes rotatable with said rotary sleeve;

a rotor eccentrically disposed within said rotary sleeve, wherein said vanes are movably fitted in said rotor;

an air-bearing room disposed between the outer periphery of said rotary sleeve and the inner periphery of said center housing; and a buffer chamber formed within said center housing;

said buffer chamber being opened to the air-bearing room;

an inlet passage extending to the inner periphery of said center housing from a discharge chamber, wherein said buffer chamber further comprises:

an arcuate groove provided in the compression side end of said center housing;

a plurality of blind holes extending axially from said arcuate groove into the wall of said center housing;

a plurality of tiny bores extending radially from the blind holes to the inner periphery of said center housing;

an arcuate groove provided in the suction side of said center housing;

a plurality of blind holes extending axially from said arcuate groove into the wall of said center housing;

a plurality of tiny bores formed in the blind holes opening to the inner periphery of said center housing; and said working space is connected to said discharge chamber, and said compression side arcuate groove being internally connected to said discharge chamber.

2. An apparatus for supporting the rotary sleeve in a rotary compressor, comprising:

a center housing;

a rotary sleeve rotatably mounted within said center housing;

a plurality of vanes rotatable with said rotary sleeve;

a rotor eccentrically disposed within said rotary sleeve, wherein said vanes are movably fitted in said rotor;

an air-bearing room disposed between the outer periphery of said rotary sleeve and the inner periphery of said center housing;

a buffer chamber within said center housing, said buffer chamber being opened to said air-bearing room;

an inlet passage extending to the inner periphery of said center housing from a working space, said working space being disposed between two adjacent vanes;

said buffer chamber further comprises:

an arcuate groove provided in the compression side end of said center housing;

a plurality of blind holes extending axially from said arcuate groove into the wall of said center housing;

a plurality of tiny bores extending radially from the blind holes to the inner periphery of said center housing;

an arcuate groove provided in a suction side end of said center housing, a plurality of blind holes extending axially from said arcuate groove into the wall of said center housing; and a plurality of tiny bores formed in the blind holes opening to the inner periphery of said center housing;

said working space is connected to said discharge chamber;

said compression side arcuate groove being internally connected to said discharge chamber.

3. An apparatus for supporting arotary sleeve in a rotary compressor, comprising:

a center housing;

a rotary sleeve rotatably mounted in said center housing;

a plurality of vanes rotatable with said rotary sleeve;

a rotor eccentrically disposed within said rotary sleeve, wherein said vanes are movably fitted in said rotor; and an air-bearing room disposed between the outer periphery of said rotary sleeve and the inner periphery of said center housing;

a buffer chamber formed within said center housing, said buffer chamber being opened to said air-bearing room; and an inlet passage extending to the inner periphery of said center housing from a discharge chamber.

4. The apparatus of claim 3, wherein the buffer chamber, comprises:

an arcuate groove provided in a compression side end of said center housing;

a plurality of blind holes extending axially from said arcuate groove into the wall of said center housing; and a plurality of tiny bores extending radially from said blind holes to the inner periphery of said center housing.

5. The apparatus of claim 3, wherein the buffer chamber, comprises:

an arcuate groove provided in a suction side end of said center housing;

a plurality of blind holes extending axially from said arcuate groove into the wall of said center housing; and a plurality of tiny bores extending radially from each blind hole to the inner periphery of said center housing.

6. The apparatus of claim 3, wherein the buffer chamber, comprises:

an arcuate groove provided in a compression side end of said center housing;

a plurality of blind holes extending axially from said arcuate groove into the wall of said center housing;

a plurality of tiny bores extending radially from the blind holes to the inner periphery of said center housing;

an arcuate groove provided in a suction side end of said center housing;

a plurality of blind holes extending axially from said arcuate groove into the wall of said center housing; and a plurality of tiny bores extending radially from each blind hole to the inner periphery of said center housing.

7. An apparatus for supporting a sleeve in a rotary compressor, comprising:

a center housing;

a rotary sleeve rotatably mounted in said center housing;

a plurality of vanes rotatable with said rotary sleeve;

a rotor eccentrically disposed within said rotary sleeve, wherein said vanes are movably fitted in said rotor and an air-bearing room disposed between the outer periphery of said rotary sleeve and the inner periphery of said center housing;

a buffer chamber within said center housing, said buffer chamber being opened to said air-bearing room; and an inlet passage extending to the inner periphery of said center housing from a working space, said working space being disposed between two adjacent vanes.

8. The apparatus of claim 7, wherein the buffer chamber, comprises:

an arcuate groove provided in a compression side end of said center housing;

a plurality of blind holes extending axially from said arcuate groove into the wall of said center housing; and a plurality of tiny bores extending radially from said blind holes to the inner periphery of said center housing.

9. The apparatus of claim 8, wherein a connecting passage connects a discharge chamber to said air-bearing room through said blind holes and said arcuate groove.

10. The apparatus of claim 7, wherein the buffer chamber, comprises:

an arcuate groove provided in a suction side end of said center housing;

a plurality of blind holes extending axially from said arcuate groove into the wall of said center housing; and a plurality of tiny bores extending radially from each blind hole to the inner periphery of said center housing.

11. The apparatus of claim 7, wherein the buffer chamber, comprises:

an arcuate groove provided in the compression side end of said center housing;

a plurality of blind holes extending axially from said arcuate groove into the wall of said center housing;

a plurality of tiny bores extending radially from the blind holes to the inner periphery of said center housing;

an arcuate groove provided in the suction side end of said center housing;

a plurality of blind holes extending axially from said arcuate groove into the wall of said center housing; and a plurality of tiny bores formed in the blind holes opening to the inner periphery of said center housing.

* * * * *